US008650998B2

(12) United States Patent
Badie et al.

(10) Patent No.: US 8,650,998 B2
(45) Date of Patent: Feb. 18, 2014

(54) MACHINE FOR AUTOMATICALLY CUTTING SHEET MATERIALS PROVIDED WITH A BULGED DEPRESSION BOX

(75) Inventors: Thierry Badie, Domaine du Cordon d'Or (FR); Didier Chabirand, Cestas (FR); Régis Lallement, Cestas (FR)

(73) Assignee: Lectra, Paris (FR)

( * ) Notice: Subject to any disclaimer, the term of this patent is extended or adjusted under 35 U.S.C. 154(b) by 1043 days.

(21) Appl. No.: 11/813,907

(22) PCT Filed: Nov. 15, 2006

(86) PCT No.: PCT/FR2006/051178

§ 371 (c)(1), (2), (4) Date: Apr. 30, 2008

(87) PCT Pub. No.: WO2007/057609

PCT Pub. Date: May 24, 2007

(65) Prior Publication Data

US 2011/0100182 A1 May 5, 2011

(30) Foreign Application Priority Data

Nov. 16, 2005 (FR) ..... 05 11599

(51) Int. Cl.
*B26D 7/06* (2006.01)

(52) U.S. Cl.
USPC ..... 83/100; 83/155; 83/451

(58) Field of Classification Search
USPC ..... 83/100, 155, 451, 422, 936, 939, 940, 83/941; 29/559; 248/362; 269/21
See application file for complete search history.

(56) References Cited

U.S. PATENT DOCUMENTS

| | | | | |
|---|---|---|---|---|
| 4,322,993 | A * | 4/1982 | Stumpf | 83/422 |
| 4,328,726 | A * | 5/1982 | Pearl | 83/39 |
| 4,476,756 | A * | 10/1984 | Pearl et al. | 83/422 |
| 4,542,672 | A * | 9/1985 | Pearl | 83/409 |
| 4,553,298 | A * | 11/1985 | Grable | 29/888.02 |
| 4,768,763 | A * | 9/1988 | Gerber | 269/21 |
| 4,836,072 | A * | 6/1989 | Gerber | 83/152 |
| 5,348,285 | A | 9/1994 | Hüser | |
| 5,819,620 | A * | 10/1998 | Bouvarel et al. | 83/100 |
| 6,546,835 | B2 * | 4/2003 | Wang | 83/477.1 |

FOREIGN PATENT DOCUMENTS

| | | |
|---|---|---|
| DE | 389202 | 2/1924 |
| EP | 0 970 896 A2 | 1/2000 |
| FR | 92 10453 | 9/1992 |
| JP | 2008-257985 | 10/1996 |
| JP | 2000-119950 | 4/2000 |

OTHER PUBLICATIONS

Japanese Office Action (English translation) dated Nov. 20, 2012 for JP2008-540666.

* cited by examiner

*Primary Examiner* — Omar Flores Sanchez
(74) *Attorney, Agent, or Firm* — Smith Gambrell & Russell LLP

(57) ABSTRACT

The invention relates to a machine for automatically cutting sheet material, the machine comprising a bench having a cutting zone, a cutter head mounted on means for moving it relative to the bundle, a cutter conveyor housed inside a box placed under the cutting zone, and means for establishing suction in the box, the box bulging outwards at least in its bottom portion that is remote from the cutting zone.

3 Claims, 2 Drawing Sheets

MACHINE FOR AUTOMATICALLY CUTTING SHEET MATERIALS PROVIDED WITH A BULGED DEPRESSION BOX

BACKGROUND OF THE INVENTION

The present invention relates to a machine for automatically cutting sheet material. More precisely, the invention relates to a machine for cutting stacks or lay-ups of sheet material, in particular textile material, using a cutter head.

Such machines are themselves well known. Reference can be made for example to document EP 0 658 087 B1. They essentially comprise a bench having a cutting zone proper, a zone for loading sheet material for cutting at an upstream end of the cutting zone, and a zone for unloading cut parts from a downstream end of the cutting zone.

The loading zone is used for initially stacking a plurality of sheets, e.g. of textile material, so as to cut out parts simultaneously from the set of stacked sheets. Under the cutting zone, there is a cutter conveyor that is used for entraining the stack of sheets during the cutting operation. Cutting is performed using a cutter head that is mounted on means enabling it to move relative to the bench, and in particular on a gantry that itself moves along guides placed along the length of the cutting zone, the cutter head being capable of moving in translation along the gantry. Finally, the unloading zone serves to transfer the stack of sheets once they have been cut up.

Within the structure of the bench, the machine also comprises a suction device enabling a high degree of suction to be established in the cutter conveyor, possibly as much as 200 mbar. The suction device thus serves to hold the sheets for cutting stationary while they are being cut. To obtain effective suction, it is generally necessary to place a film of airtight material over the top of the stack of sheets for cutting.

In operation, it has been found that the structure of the bench in that type of cutter machine is subjected to large amounts of structural deformation. In particular, under the effect of the suction generated in the vicinity of the cutter conveyor, the guides along which the gantry moves can become so deformed as to be twisted. This leads to a corresponding deformation of the gantry involving friction and a loss of accuracy in the movements of the cutter head and to premature wear of those elements. Another drawback of those deformations is accelerated fatigue of the general structure of the cutter machine shortening its lifetime.

In an attempt to remedy those drawbacks, proposals have been made to stiffen the general structure of the cutter machine, e.g. by making the structure out of ever more rigid materials using ever increasing thicknesses, and adding structural reinforcement such as beams, stays, etc.

The consequence of applying those modifications is to considerably increase the weight and the cost of the cutter machine. Indirectly, costs involved with transporting and installing the machine are also increased because of the constraints put on preparing the premises where the machine is to be used.

OBJECT AND SUMMARY OF THE INVENTION

A main object of the present invention is to mitigate such drawbacks by increasing the strength of the general structure of the cutter machine, but without thereby increasing its weight and thus its costs of manufacture, transport, and installation.

This object is achieved by a machine for automatically cutting sheet material, the machine comprising a bench having a cutting zone, a cutter head mounted on means for moving it relative to the bundle, a cutter conveyor housed inside a box placed under the cutting zone, and means for establishing suction in the box, and in which, in accordance with the invention, the box bulges outwards at least in its bottom portion that is remote from the cutting zone.

Using a suction box that bulges outwards, at least in its bottom portion, serves to limit considerably the structural deformation to which the cutting machine is subjected in operation. This leads to savings in terms of weight of the order of 30% compared with a conventional cutter machine of the kind described above.

The bottom portion of the box may be curved outwards relative to the box in cross-section, while being substantially straight in longitudinal section.

Preferably, the box bulges outwards in its bottom portion that is remote from the cutting zone, and also in its transverse portions.

BRIEF DESCRIPTION OF THE DRAWINGS

Other characteristics and advantages of the present invention appear from the following description made with reference to the accompanying drawings that show an embodiment having no limiting character. In the figures.

DETAILED DESCRIPTION OF AN EMBODIMENT

Figure 1:
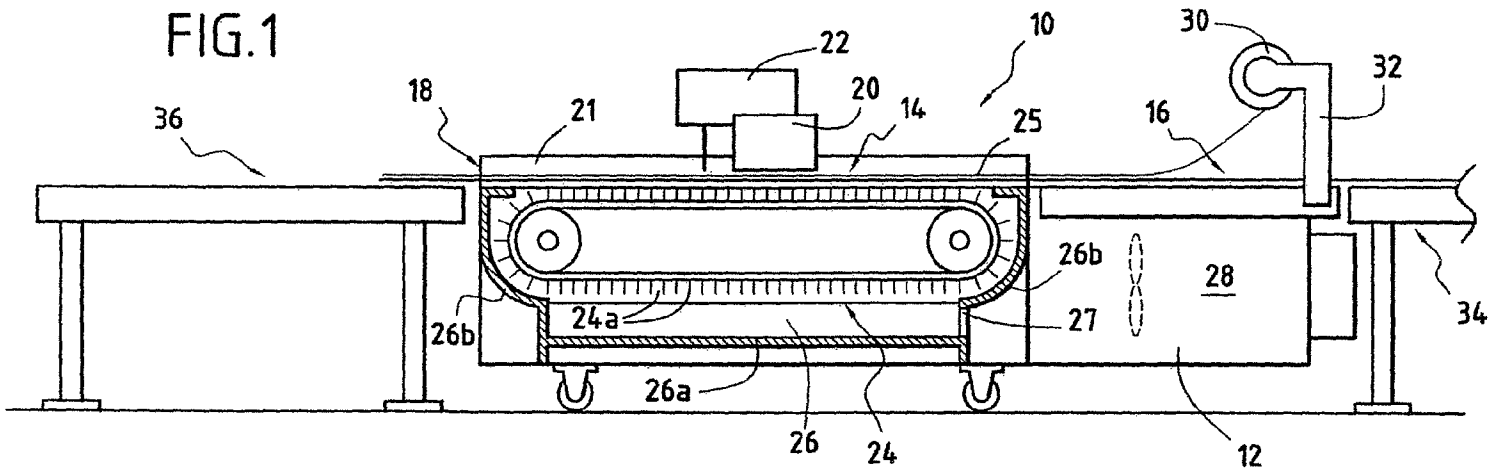
FIG. 1 is a diagrammatic view of a cutter machine constituting an embodiment of the invention.

The machine of the invention for automatic cutting of sheet material comprises a bench 10 having a structure 12 of elongate shape. The top face of the structure 12 defines a cutting zone 14, a zone 16 for receiving a load of sheet material for cutting upstream from the cutting zone, and a zone 18 for unloading cut pieces downstream from the cutting zone.

Over the bench 10, a gantry 20 secured to the structure 12 is suitable for moving along guides 21 disposed along the length of the cutting zone 14. The gantry carries a cutter head 22 that is movable along the length of the gantry. As is well known, the cutter head 22 can reach any point in the cutting zone 14.

The cutter machine also has a cutter conveyor 24 that is housed inside the structure 12 on the bench 10 under the cutting zone 14. The cutter conveyor 24 serves to entrain the sheet for cutting 25 during the cutting operation when the length of the sheet is greater than the working length of the cutting zone.

The cutter conveyor 24, with the exception of its horizontal top surface defining the cutting zone, is housed inside a sealed box 26 that is secured to the structure 12 of the bench 10. The box 26 is connected to a turbine suction device 28 also mounted inside the structure 12 of the bench 10.

The cutter conveyor 24 is made up of blocks **24*a* forming between them passages that put the inside of the box 26 into communication with the surface of the bench 10. The blocks 24*a*** comprise a base from which there projects a plurality of wire-like elements.

The box 26 of substantially rectangular shape extends longitudinally over at least the entire length of the cutting zone 14. It is made up of a bottom face **26*a* remote from the surface of the bench 10, two transverse faces 26***b*, and two longitudinal faces 26*c* that may be formed by the structure 12 of the bench 10.

As shown diagrammatically in FIG. 1, a duct 27 serves to connect the turbine suction device 28 to the box 26, e.g. through one of its transverse faces 26*b*.

The turbine suction device 28 serves to establish suction inside the box 26 in which the cutter conveyor 24 is housed. Thus, under the combined effect of the atmospheric pressure applied to the sheet for cutting and the suction maintained inside the box 26 by suction through the blocks 24*a* of the cutter conveyor 24, the sheet 25 for cutting is held stationary during the cutting operation.

In order to obtain effective suction, it is also possible to cover the sheet 25 for cutting with a flexible film of airtight material. This can be stored in the form of a plurality of horizontal rollers 30 that are mounted on a roller carrier 32 placed at the upstream end of the bench 10. The roller carrier 32 is secured to the structure 12 of the bench.

The operation of the cutter machine can be seen clearly from the above description.

A stack of sheets for cutting (e.g. of a textile material such as a fabric) can initially be built up, e.g. on a cloth-spreading bench 34 disposed upstream from the bench 10. Alternatively, the sheets may be cut one by one.

The stack of sheets for cutting is then transferred onto the bench 10 via its loading zone 16. The airtight film is pulled from the roller(s) 30 and is placed on the stack of sheets so as to cover it completely.

The stack of sheets covered by the airtight film is advanced along the bench 10 under the drive effect of the cutter conveyor 24. Over the cutting zone 14, the stack of sheets is cut by means of the cutter head 22 mounted on the gantry 20. The cutter head is controlled to follow a predetermined path.

During this cutting operation, the stack of sheets covered in the airtight film is held firmly on the bench by the suction established in the box 26.

Once it has been cut up, the stack of sheets is taken to the unloading zone 18, still under drive from the cutter conveyor 24. An unloading bench 36 may optionally be placed downstream from the bench 10 for this purpose.

In accordance with the invention, the box 26 in which the cutter conveyor 24 is housed bulges outwards at least in its bottom portion (i.e. its portion remote from the cutting zone 14).

Preferably, the box bulges outwards in its bottom portion 26*a* remote from the cutting zone 14, and also in its transverse portions 26*b*.

Figure 4:
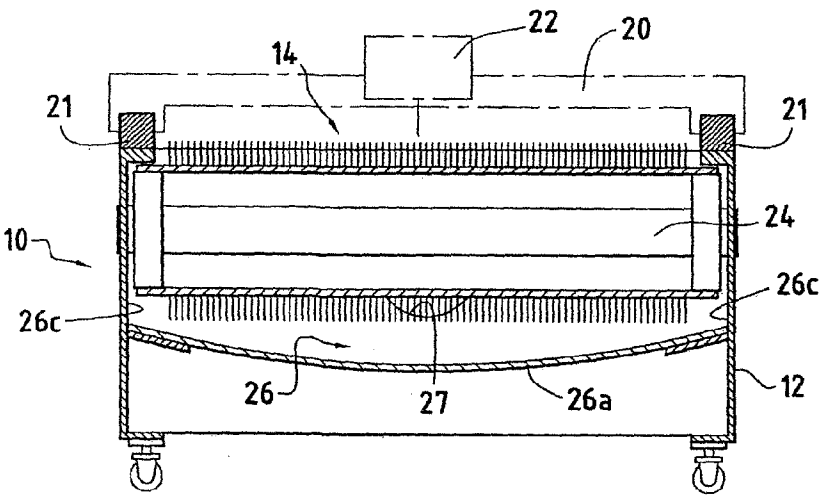
FIG. 4 is a cross-section view of the FIG. 1 cutter machine.
Figure 2:
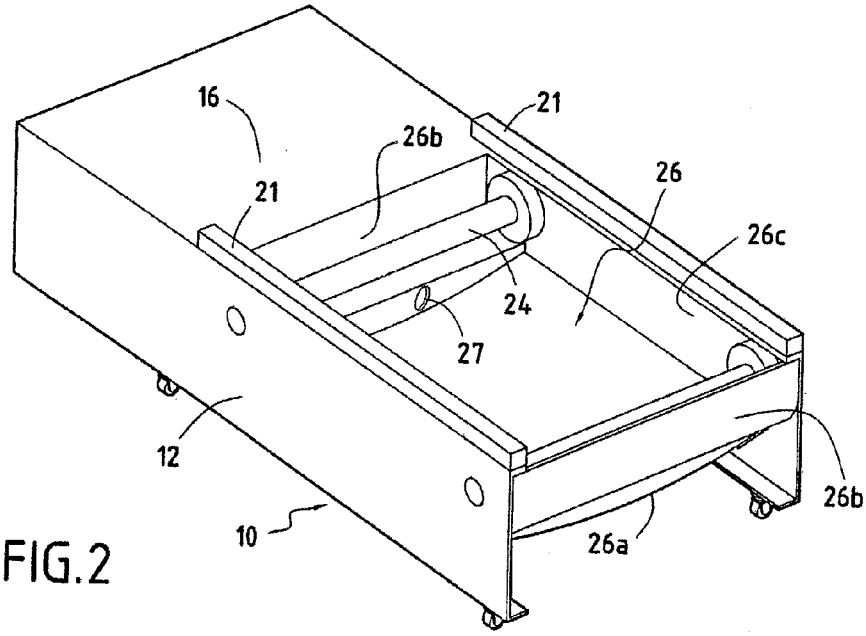
FIGS. 2 and 3 are fragmentary perspective views of the FIG. 1 cutter machine.
Figure 3:
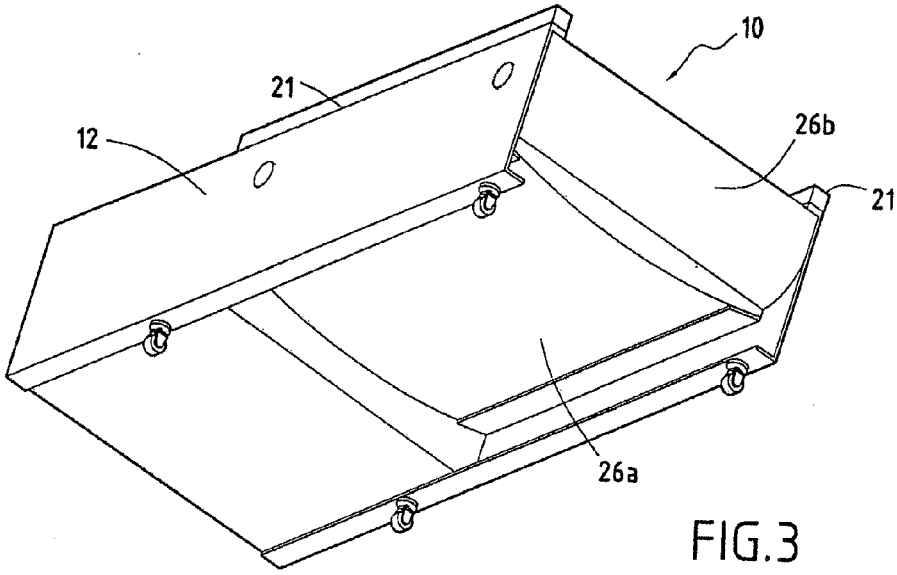

This characteristic which serves to attenuate the harmful effects on the structure of the bench that are caused by establishing suction in the cutter conveyor, can be seen particularly clearly in FIGS. 2 to 4 which show a portion of the bench of the cutter machine of the invention. It will be understood that for reasons of clarity, the cutter conveyor 24 of the bench is shown in part only in FIG. 2.

In these figures, both the bottom face 26*a* remote from the surface of the bench, and the transverse faces 26*b* of the box 26 present a shape that is rounded towards the outside of the box.

It can be seen that in the embodiment shown in the figures, the bottom face 26*a* of the box is curved outwards in cross-section (FIG. 4) while being substantially straight in longitudinal section (FIG. 1).

Alternatively, the bottom face of the box could be substantially straight in cross-section while curving outwards in longitudinal section.

The bulging shape of the box can be obtained using walls that are either completely curved, or least that are made up of a succession of plane facets with rounded portions between one another.

The degree of curvature of the bulging portions of the box depends on various parameters such as the level of suction desired inside the box, the dimensions of the box, the dimensions of the cutting bench, etc.

In a variant embodiment that is not shown in the figures, the box 26 could also bulge outwards in its longitudinal faces 26*c*.

The Applicant has found that using a box that bulges outwardly at least in its bottom portion serves to increase considerably the strength of the bench to withstand deformation due to the pressure and suction applied thereto. Thus, compared with a prior art machine, the use of such a box makes it possible to reduce the total weight of the machine by about 30%.

What is claimed is:

1. A machine for automatically cutting sheet material, the machine comprising a bench having a cutting zone, a cutter head mounted on means for moving the cutter head relative to a load of sheet material, a cutter conveyor housed inside a generally rectangular box, the box having a bottom face that is remote from the cutting zone of the bench, that is placed under the cutting zone, and that bulges outwardly, and means for establishing suction in the box, wherein the suction in the suction box is sufficient to hold the sheet material stationary on the cutter conveyor in the cutting zone.

2. A machine according to claim 1, in which the bottom face of the box curves outwards relative to the box in cross-section, while being substantially straight in longitudinal section.

3. A machine according to claim 1, in which the box bulges outwards in its bottom face that is remote from the cutting zone, and also in its transverse portions.

* * * * *